United States Patent [19]

Wible

[11] 4,070,857

[45] Jan. 31, 1978

[54] HYDRAULIC PRIORITY CIRCUIT

[75] Inventor: John E. Wible, Painesville, Ohio

[73] Assignee: Towmotor Corporation, Mentor, Ohio

[21] Appl. No.: 753,250

[22] Filed: Dec. 22, 1976

[51] Int. Cl.[2] ..... F15B 11/16; F15B 11/20

[52] U.S. Cl. ..... 60/422; 60/431; 60/484; 91/412

[58] Field of Search ..... 60/328, 420, 422, 423, 60/431, 445, 449, 459, 468, 484, DIG. 2; 91/412; 137/101, 109

[56] References Cited

U.S. PATENT DOCUMENTS

| | | | |
|---|---|---|---|
| 3,355,994 | 12/1967 | Malott | 60/430 X |
| 3,979,908 | 9/1976 | Alderson | 60/422 |

FOREIGN PATENT DOCUMENTS

| | | |
|---|---|---|
| 1,385,099 | 2/1975 | United Kingdom. |

*Primary Examiner*—Edgar W. Geoghegan
*Attorney, Agent, or Firm*—Phillips, Moore, Weissenberger, Lempio & Majestic

[57] ABSTRACT

A hydraulic priority circuit for a fork lift truck or the like includes a variable output pump controlled by a motor. The speed of the motor is controlled by feedback from a demand indicator in a primary work system, such as a hydraulic steering system, and from a demand indicator in a secondary work system, including, for example, tilt and lift hydraulic circuits. A valve means, including a priority control valve, a sequence valve, and pressure compensated flow control orifices, is provided to regulate the fluid flow requirements of the primary work system on a priority demand basis, with the excess fluid flow being coupled to the secondary work system.

12 Claims, 1 Drawing Figure

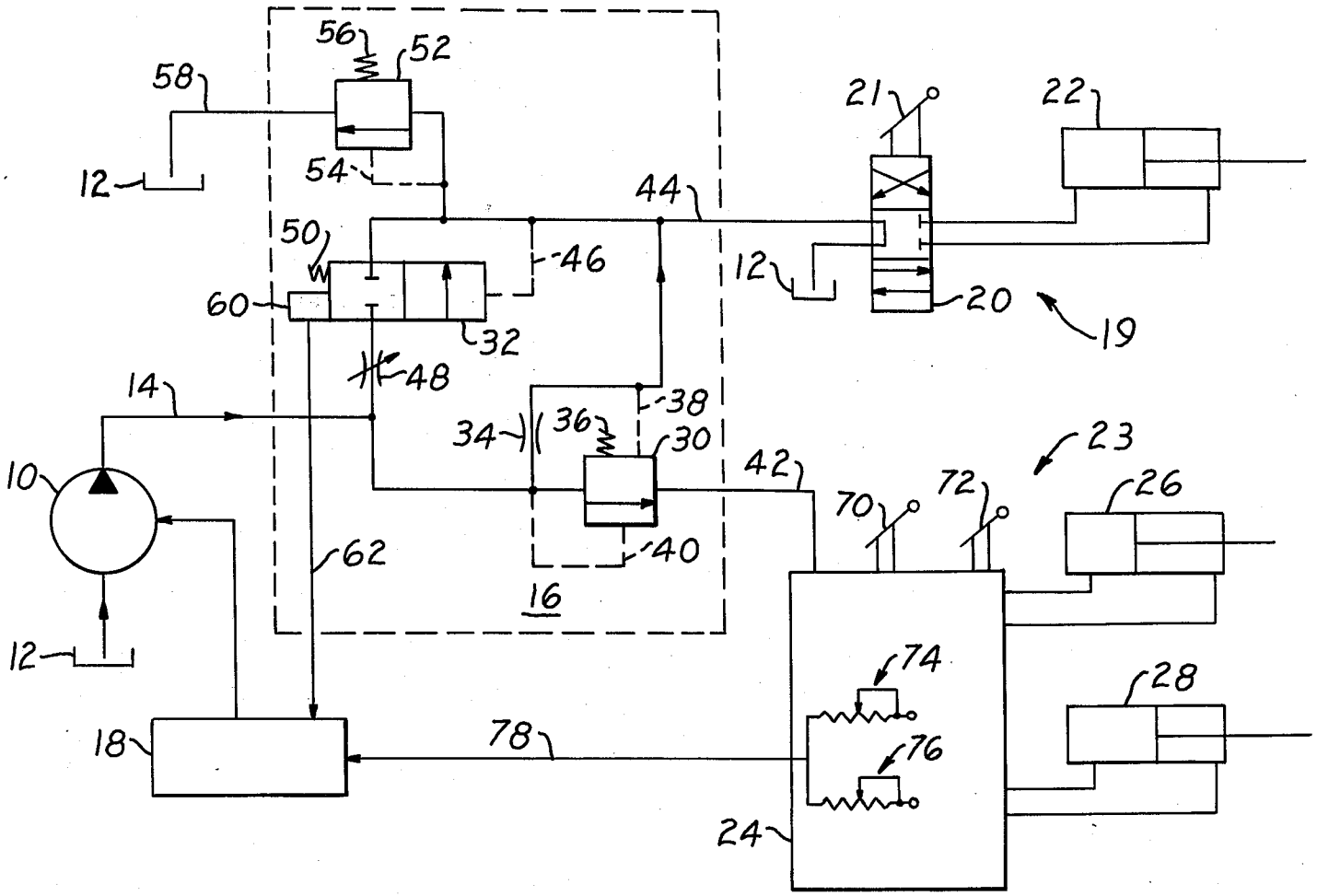
10
12
14
16
18
19
20
21
22
23
24
26
28
30
32
34
36
38
40
42
44
46
48
50
52
54
56
58
60
62
70
72
74
76
78

HYDRAULIC PRIORITY CIRCUIT

BACKGROUND OF THE INVENTION

1. Field of the Invention

The present invention relates in general to a hydraulic priority circuit and more specifically to a hydraulic priority circuit having a single pump and a means for varying the output of the pump as a function of changing demands for fluid flow in a primary work system and in a secondary work system.

2. Description of the Prior Art

The use of a priority flow control valve in a fork lift truck, for example, to combine a steering circuit and a secondary circuit including fork tilt and lift circuits is well-known in the art. In such systems a priority valve commonly assures that a full flow of fluid is continuously supplied to the steering circuit to assure steering control independent of other hydraulic system requirements. Obviously, such a system wastes a significant amount of flow power which might otherwise be available to the rest of the hydraulic system. More recent hydraulic circuits have included priority control valve means wherein a lesser control fluid flow is provided to the steering circuit, with the full flow only being provided upon demand to the steering circuit. However even in such a system as this, the pump is continuously operated at a full flow rate so that waste of system power still occurs since the excess flow is also not necessarily needed by the hydraulic system.

SUMMARY OF THE INVENTION

The present invention is directed to overcoming one or more of the problems as set forth above. According to the present invention, the apparatus comprises an improved hydraulic priority circuit that circumvents the above-described problems by providing in combination with a priority valve circuit having a reduced control flow to the steering system, a feedback element that functions to allow the pump to operate at a much lower flow level until steering demand has been indicated. Further, the pump flow rate supplied to the secondary work system is kept at a minimum through secondary feedback means, so that again the pump does not have to operate at a higher flow rate than is required at a given time by the system. Thus, the present invention provides a system wherein a minimum of power is wasted, wherein only a limited amount of control fluid is required by the primary work system to insure proper operation thereof and wherein means for indicating an increased demand for fluid by the system is fed back to the pump motor to cause the fluid flow generated by said pump to increase.

Broadly stated, the present invention comprises a hydraulic priority circuit including variable output fluid pump means, a primary work system, a secondary work system, and valve means for regulating the flow of fluid from the pump means to said primary work system and said secondary work system on a priority demand basis. The valve means includes indicator means for indicating the demand for an increased level of fluid flow to said primary work system. Further, these indicator means are actuated upon detecting from said primary work system an increased fluid pressure. Finally, means are included that are responsive to said indicator means for increasing the output of said pump means.

BRIEF DESCRIPTION OF THE DRAWING

These and other objects and advantages of the present invention will become apparent from the following description and the accompanying drawing in which the lone FIGURE is a schematic representation of the current invention.

DETAILED DESCRIPTION OF THE PREFERRED EMBODIMENT

Referring now to the drawing, the hydraulic priority circuit of the present invention includes a variable output pump means comprising in the present embodiment a fixed displacement variable speed pump 10, with pump 10 output varying as a function of pump speed. The pump 10 has its inlet connected to a tank, reservoir, or oil supply 12 such that a suitable fluid such as oil may be drawn therefrom, and has its outlet connected by a conduit 14 to the valve means 16. The speed of the pump 10 is controlled by a pump motor unit 18. This motor 18 includes means that are common in the art for controlling the speed of said motor. The operation of the motor 18 will be described in more detail hereinbelow. The valve means 16 controls the amount of fluid flow directed to a primary work system 19. In the present embodiment this work system 19 is a steering unit for a fork lift truck. Included therein is a steering directional control valve 20, operated in a conventional manner such as by a control arm 21, and a steering cylinder or actuator 22. The secondary work system 23 includes the implement control valve means 24 and cylinders 26 and 28. The valve means 24 of the present embodiment controls the tilt and lift operations of the fork lift truck, i.e. the means for raising and lowering load carrying forks on a mast and for tilting said mast, through the use of corresponding cylinders for tilt 26 and for lift 28. Other auxiliary functions may also be performed by the secondary work system of the present invention.

The valve means 16 includes a priority control valve means 30 and a sequence valve means 32. These two valve means provide alternate paths of fluid flow to the work system 19. The priority control valve means 30 includes a flow control orifice means 34 that is pressure compensated to ensure constant flow of fluid regardless of the changes in the fluid pressure in conduit 14 which acts as an inlet to the orifice 34. The orifice 34 is designed to allow a set minimum of fluid flow, i.e. a control flow, to be supplied to the steering unit. Any excess flow from the fluid pump 10 is allowed to pass through the priority valve 30 to the secondary work system 23. This would occur, for example, when there is no fluid demand by the steering unit, but fluid flow was required by the secondary work system.

The priority control valve 30 includes a spring biasing means 36 and pilot control paths 38 and 40 to enable valve 30 to automatically respond to a pressure differential between the fluid pressure in the primary work system 19 and the fluid pressure of the fluid flow from the pump 10 as sensed in conduit 14. As can be seen, the spring 36 biases the valve 30 to allow the fluid flow to be first directed through orifice 34. Only when a flow greater than this exists will the above mentioned pilot controls 38, 40 sense a differential pressure to cause the opening of valve 30 and thereby allow this excess flow to be coupled to the secondary work system 23. The excess flow is coupled to the work system 23 via an output conduit 42. The control flow supplied to the primary work system 19 by means of orifice 34 is coupled through a primary work system conduit 44 to the steering control valve 20. This valve 20 is an open center valve, so that when no steering is required, the control flow supplied thereto is allowed to drain back into the system tank or reservoir 12. In the present embodiment, the volume of control flow is set at 0.5 gallons per minute.

When the steering control valve 20 is actuated, the flow from conduit 44 to tank via this valve is cut off. Since the control flow is supplied to conduit 44 via orifice 34 irrespective of the extent of pressure buildup in this conduit, the result is that the pressure in conduit 44 increases as resistance to movement of the steering cylinder 22 is felt. Thus, the function of the control flow via orifice 34 is to provide a means for enabling a stepped-up fluid flow to be supplied to the steering unit 19 when steering demand is indicated. That is, the orifice 34 and flow therethrough provides a control flow that enables actuation of a steering boost flow. Consequently, the need for this steering boost flow is sensed by the pressure build-up in conduit 44 caused by the control flow from orifice 34. When this pressure reaches or exceeds a preset control pressure level, e.g. 200 PSI, it causes sequence valve 32 to actuate via pilot control path 46. The sequence valve 32, when it is actuated, provides the desired increased fluid flow to the steering unit 19. The amount of maximum fluid flow available from the valve 32 is controlled by a second pressure compensated flow control orifice means 48. In the present embodiment, this maximum fluid flow is limited to 2 gal. per minute. Thus, the total fluid flow available to the steering unit 19 is the sum total of the flow supplied by orifice 48 and the control flow supplied by orifice 34.

Note that since the amount of fluid flowing though conduit 44 to the steering unit 19 is controlled by the size of the orifice 48, different rates of flow can be established by varying this orifice size. Consequently the size can be adjusted as a function of the requirements of a given primary work system 19. Also, the sequence valve 32 is actuated when the pressure in the pilot control line 46 is sufficient to counteract the spring bias of a biasing means 50. No fluid flow is enabled via valve 32 until this occurs. The biasing means 50 is operatively attached to the valve 32 by means known to those skilled in the art.

A relief valve 52 is provided to ensure that a maximum pressure is not exceeded in the conduit 44. This pressure sensing is provided by means of a pilot control path 54 and an oppositely biased spring biasing means 56. In operation, the relief valve 52 opens only when the pressure in conduit 44 reaches a certain maximum amount, e.g. 1,000 PSI, such that the pressure is sufficient to counteract the effect of the biasing means 56. When valve 52 is actuated, the output fluid flow generated is coupled via a conduit 58 back to the system tank or reservoir 12.

To enable the most efficient use of fluid flow from the pump 10 by the primary and secondary work systems 19 and 23, feedback is provided in both systems to enable the fluid flow to be varied in response to sensed demand. The preferred embodiment of the present invention is to operate pump 10 such that an output fluid flow of an amount sufficient only to provide the control flow through orifice 34 is produced when no demand by either system 19 or 23 is sensed. Means are provided to boost the output flow of the pump 10 when steering demand is sensed, i.e. when, as described above, the increased pressure in conduit 44 activates sequence valve 32. This means for providing a boost in pump 10 output flow may comprise an electrical signal which is generated at the same time that sequence valve 32 is actuated. This signal is coupled to the pump motor unit 18 to operatively increase the pump motor speed and thereby the fluid output of pump 10. Note that this function may also be performed hydraulically using fluid feedback from conduit 44 or valve 32 to a variable displacement pump in place of the pump 10.

A plurality of possible electrical means for indicating an increased fluid flow demand may be used. Specifically, a switch 60 may be operatively attached to the sequence valve 32 adjacent to the spring end of this valve such that when valve 32 is actuated in response to the detected increased fluid pressure in the conduit 44, the switch 60 closes in response thereto. This switch 60 closure generates thereby an electrical signal in a manner common to the art, which is coupled via a conductor 62 to the pump motor speed control 18. A similar result could be obtained by using an electrical pressure switch operatively coupled to the conduit 44 for separate detection thereby of the increased pressure in this conduit.

To further improve the efficiency of the hydraulic priority circuit of the present invention, a secondary feedback means is also provided. This feedback means controls the amount of output fluid flow generated by the pump 10 as a function of the changed demand of the secondary work system 23. In the present embodiment, the secondary work system 23 includes two functions, the tilt and lift functions for a fork lift truck, controlled by the implement control valve means 24. When either a tilt or a lift function is desired, a corresponding tilt control arm 70 or lift control arm 72 is actuated by the truck operator. This actuation causes the valve means 24 to couple fluid flow to the corresponding cylinder 26 or 28 in a manner common to the art.

The valve means 24 further includes respective potentiometers, or rheostats, including a tilt arm position potentiometer 74 and a lift arm position potentiometer 76. These potentiometers 74, 76 are operatively connected to their respective control arms 70, 72. Note that switches can be used in place of the potentiometer if variable levels of feedback are not required. Thus, as a given control arm 70, 72 is operatively positioned to control the actuation of its corresponding cylinder 26, 28, the potentiometer attached to said given control arm 70, 72 is caused to indicate a changed resistance. This indicated changed resistance is coupled to the pump motor speed control 18 by means of an electric signal generated therefrom in a manner common in the art, such as by connecting one side of the potentiometer to a voltage source and connecting the other side to the pump motor 18 via a conductor 78. The magnitude of this signal would therefore be proportional to the given potentiometer 74, 76 resistance setting. Note that the outputs of both of the potentiometers 74 and 76 may be tied in common, so that the resultant signal seen by the pump motor unit 18 would indicate the sum total of the fluid demand from both the tilt and the lift hydraulic circuits.

Thus, besides primary work system 19 demands, only the amount of fluid which is needed in the secondary work system 23 is outputted by the pump 10. The fluid demand is indicated by the extent of actuation of either the tilt control arm 70 or the lift control arm 72 or both, which generates a signal that is fed back to the motor speed control 18 via conductor 78. This signal increases or decreases the pump motor 18 speed, and as a result increases or decreases the output fluid flow from the pump 10 to satisfy this changed fluid flow demand.

In conclusion, the apparatus of the present invention enables a minimum of fluid flow to be supplied from the pump 10 when neither the primary work system 19 nor the secondary work system 23 are being operated. Secondly, when either of these systems require increased fluid flow from the pump 10, feedback means are provided, including the pressure sensitive switch 60 and the potentiometers 74, 76. These means indicate to the pump motor and speed control unit 18 that an increased pump flow output is required. Finally, when both systems 19 and 23 require fluid flow, the valve means 16 enables demand priority to be given to the primary work system 19, via priority control valve 30 such that the flow demands of this work system 19 are satisfied before any excess fluid flow is enabled to be coupled by means of conduit 42 to the secondary work system 23. The valve means 16 further includes a sequence valve 32 for enabling the increased demand flow to be coupled to the primary work system, at a predetermined adjustable flow rate.

The present embodiment of this invention is to be considered in all respects as illustrative and not restrictive; the scope of the invention being indicated by the appendent claims rather than by the foregoing description, and all changes which come within the meaning and the range of equivalency of the claims therefore are intended to be embraced therein.

The embodiments of the invention in which an exclusive property or privilege is claimed are defined as follows:

1. A hydraulic priority circuit comprising:
variable output fluid pump means;
a primary work system;
a secondary work system;
valve means for regulating the flow of fluid flow from said pump means to said primary work system and said secondary work system on a priority demand basis, said valve means including indicator means for indicating demand for an increased level of fluid flow to said primary work system, said means actuated upon detecting from said primary work system an increased fluid pressure; and
means responsive to said indicator means for increasing the output of said pump means.

2. The hydraulic priority circuit of claim 1, wherein said means responsive to said indicator means comprises a variable speed motor operatively coupled to said pump means for driving said pump means at one of a plurality of speeds, said pump means comprising a fixed displacement pump.

3. The hydraulic priority circuit of claim 1, wherein said valve means further comprises:
priority control valve means for providing a minimum amount of fluid flow to said primary work system and for directing any excess fluid flow to said secondary work system; and
sequence valve means responsive to an increased fluid pressure in said primary work system for supplying an increased fluid flow to said primary work system.

4. The hydraulic priority circuit of claim 3, wherein said indicator means includes an electric switch adjacent said sequence valve, such that when said sequence valve is caused to respond to an increased pressure, said switch changes state as a function thereof.

5. The hydraulic priority circuit of claim 3, wherein said priority control valve means includes first pressure compensated flow control orifice means and biasing means for providing a minimum fluid flow to said primary work system from said pump means before fluid flow is allowed to said secondary work system, and means for automatically responding to a pressure differential between the fluid pressure in said primary work system and the fluid pressure of the fluid flow from said pump means for directing any excess fluid flow to said secondary work system.

6. The hydraulic priority circuit of claim 3, wherein said sequence valve means further comprises second pressure compensated flow control orifice means for limiting the fluid flow from said pump means to said primary work system to a preset maximum amount.

7. The hydraulic priority circuit of claim 6 wherein said second pressure compensated flow orifice means includes adjustable orifice means such that said maximum flow to the primary work system can be adjusted thereby.

8. The hydraulic priority circuit of claim 3 wherein said valve means further comprises means for limiting the maximum fluid pressure to said primary work system, said means comprising a pressure relief valve.

9. The hydraulic priority circuit of claim 2, further comprising secondary feedback means for detecting a changed demand for fluid flow to said secondary work system and for indicating this demand change to said motor to cause said motor to vary its speed in response thereto.

10. The hydraulic priority circuit of claim 9 wherein said secondary work system includes a control arm enabled to be operatively positionable to control the degree of actuation of said secondary work system, and wherein said secondary feedback means comprises at least one potentiometer attached to said control arm, the setting of which varies as a function of control arm position, and including means for coupling an electric signal to said motor, said signal having a magnitude proportional to said potentiometer setting, such that as said secondary work system is caused to be energized by said control arm, said signal causes said motor to vary its speed in response thereto.

11. A hydraulic priority circuit for a fork lift truck or the like including a primary work system comprising a hydraulically operated steering means, and comprising a secondary work system comprising hydraulically operated means for raising and lowering load carrying forks on a mast and for tilting said mast, said hydraulic priority circuit comprising:
variable output fluid pump means;
a motor operatively coupled to said pump means for driving said pump means at one of a plurality of speed such that said pump means output is controlled thereby;
valve means for regulating the flow of fluid from said pump means to said primary work system and said secondary work system on a priority demand basis, said valve means including first pressure compensated flow control orifice means for providing a minimum fluid flow from said pump means to said primary work system, means for automatically responding to a pressure differential between the fluid pressure in said primary work system and the fluid pressure of the fluid flow from said pump means such that any excess fluid flow not needed by said primary work system is directed to said secondary work system, sequence valve means responsive to an increased fluid pressure in said primary work system for supplying an increased fluid flow from said pump means to said primary work system, said sequence valve means further including second pressure compensated flow control orifice means for limiting the fluid flow from said pump means to said primary work system to a preset maximum amount, and indicator means for indicating said demand for an increased level of fluid flow to said primary work system, said indicator means actuated upon detecting from said primary work system an increased fluid pressure; and means for coupling said demand indication to said motor to cause the speed of said motor to increase thereby.

12. The hydraulic circuit of claim 11 further comprising secondary feedback means for detecting a changed demand for fluid flow to said secondary work system, said secondary work system including a control arm enabled to be operatively positionable to control the degree of actuation of said secondary work system, and wherein said secondary feedback means comprises at least one potentiometer attached to said control arm, the setting of which varies as a function of control arm position, and including means for coupling an electric signal to said motor, said signal having a magnitude proportional to said potentiometer setting, such that as said secondary work system is caused to be energized by said control arm, said signal causes said motor to vary its speed in response thereto.

* * * * *

UNITED STATES PATENT OFFICE

CERTIFICATE OF CORRECTION

Patent No. 4,070,857 Dated Jan. 31, 1978

Inventor(s) JOHN E. WIBLE, Assigned to: Towmotor Corporation

It is certified that error appears in the above-identified patent and that said Letters Patent are hereby corrected as shown below:

In claim 1, line 5

"fluid flow" should be --fluid--

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*